US009061489B2

(12) United States Patent
Sakurai et al.

(10) Patent No.: US 9,061,489 B2
(45) Date of Patent: Jun. 23, 2015

(54) SUBSTRATE FOR INKJET HEAD AND INKJET HEAD HAVING PROTECTION LAYER INCLUDING INDIVIDUAL SECTIONS CORRESPONDING TO HEATING RESISTORS

(71) Applicant: CANON KABUSHIKI KAISHA, Tokyo (JP)

(72) Inventors: Makoto Sakurai, Kawasaki (JP); Yuzuru Ishida, Yokohama (JP); Takuya Hatsui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/138,295

(22) Filed: Dec. 23, 2013

(65) Prior Publication Data

US 2014/0184700 A1 Jul. 3, 2014

(30) Foreign Application Priority Data

Dec. 27, 2012 (JP) ..... 2012-285440

(51) Int. Cl.

| | |
|---|---|
| ***B41J 2/05*** | (2006.01) |
| ***B41J 2/045*** | (2006.01) |
| ***B41J 2/14*** | (2006.01) |
| ***B41J 2/16*** | (2006.01) |

(52) U.S. Cl.

CPC ..... *B41J 2/0451* (2013.01); *B41J 2/0458* (2013.01); *B41J 2/14129* (2013.01); *B41J 2/1603* (2013.01); *B41J 2/1628* (2013.01); *B41J 2/1629* (2013.01); *B41J 2/1631* (2013.01); *B41J 2/1642* (2013.01); *B41J 2/1646* (2013.01); *B41J 2002/14387* (2013.01)

(58) Field of Classification Search

USPC ..... 347/61–65, 22, 23, 19

See application file for complete search history.

(56) References Cited

U.S. PATENT DOCUMENTS 4,777,494 A * 10/1988 Shibata et al. ..... 347/64
6,231,166 B1 5/2001 Kawai et al.

(Continued)

FOREIGN PATENT DOCUMENTS

CN 1636734 A 7/2005
CN 1732086 A 2/2006

(Continued)

OTHER PUBLICATIONS

U.S. Appl. No. 14/138,287, filed Dec. 23, 2013.

(Continued)

*Primary Examiner* — Henok Legesse

(74) *Attorney, Agent, or Firm* — Fitzpatrick, Cella, Harper & Scinto

(57) ABSTRACT

There are provided a substrate for an inkjet head and an inkjet head wherein in a case where a protection layer of heating resistors is energized, an electrical connection with portions around the protection layer is more reliably cut. A first protection layer provided for the substrate for an inkjet head includes individual sections provided at positions corresponding to the plurality of heating resistors and a common section which commonly connects the plurality of individual sections. The individual sections and the common section are connected via connect sections which are eluted and connect in a case where an electrochemical reaction occurs between the connect sections and ink when electricity flow therethrough, so that an electrical connection between the individual sections and the common section is cut.

11 Claims, 9 Drawing Sheets

(56) References Cited

U.S. PATENT DOCUMENTS

| | | | | |
|---|---|---|---|---|
| 6,361,150 | B1 | 3/2002 | Schulte et al. | |
| 6,485,131 | B1 | 11/2002 | Saito et al. | |
| 6,512,284 | B2 | 1/2003 | Schulte et al. | |
| 6,663,228 | B2 | 12/2003 | Saito et al. | |
| 7,374,275 | B2 | 5/2008 | Shibata et al. | |
| 7,566,116 | B2 | 7/2009 | Saito et al. | |
| 7,862,155 | B2 | 1/2011 | Shibata et al. | |
| 7,896,476 | B2 | 3/2011 | Kubo et al. | |
| 7,950,769 | B2 | 5/2011 | Sakai et al. | |
| 7,954,238 | B2 | 6/2011 | Shibata et al. | |
| 8,070,267 | B2 | 12/2011 | Takeuchi et al. | |
| 8,075,102 | B2 | 12/2011 | Hatsui et al. | |
| 8,129,204 | B2 | 3/2012 | Saito et al. | |
| 8,191,988 | B2 | 6/2012 | Matsui et al. | |
| 8,943,690 | B2 | 2/2015 | Ishida et al. | |
| 2002/0024565 | A1 | 2/2002 | Ozaki et al. | |
| 2003/0103111 | A1 | 6/2003 | Saito et al. | |
| 2004/0017420 | A1 | 1/2004 | Miyamoto et al. | |
| 2005/0057611 | A1* | 3/2005 | Miyamoto et al. | 347/64 |
| 2005/0140732 | A1 | 6/2005 | Oikawa et al. | |
| 2007/0146428 | A1 | 6/2007 | Sakai et al. | |
| 2009/0315954 | A1* | 12/2009 | Sakurai et al. | 347/63 |
| 2010/0079551 | A1 | 4/2010 | Saito et al. | |
| 2010/0123759 | A1 | 5/2010 | Matsui et al. | |
| 2012/0047737 | A1 | 3/2012 | Ishida et al. | |
| 2012/0105537 | A1 | 5/2012 | Sakai et al. | |

FOREIGN PATENT DOCUMENTS

| | | | |
|---|---|---|---|
| CN | 1978198 | A | 6/2007 |
| CN | 101734014 | A | 6/2010 |
| CN | 102398422 | A | 4/2012 |
| EP | 0636478 | A2 | 2/1995 |
| EP | 1080897 | A2 | 3/2001 |
| EP | 1 318 018 | A1 | 6/2003 |
| EP | 1352744 | A2 | 10/2003 |
| JP | 3828728 | B2 | 7/2006 |

OTHER PUBLICATIONS

U.S. Appl. No. 14/138,344, filed Dec. 23, 2013.

Extended European Search Report for EP application No. 13005720.1 issued Mar. 18, 2014 (6 pages).

Chinese office action and translation issued in corresponding application No. 201310741027.1 dated Mar. 27, 2015—22 pages.

* cited by examiner

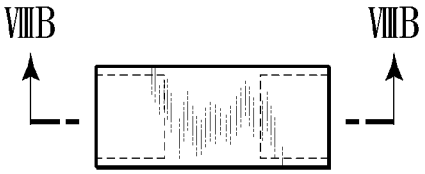
FIG.8A
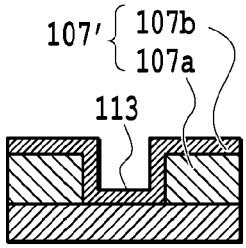
FIG.8B
FIG.8C
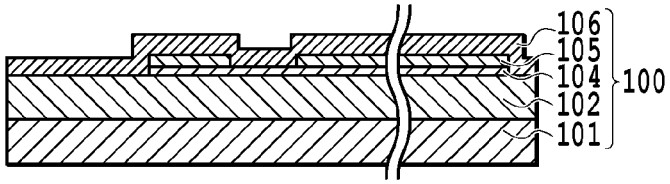
FIG.8D
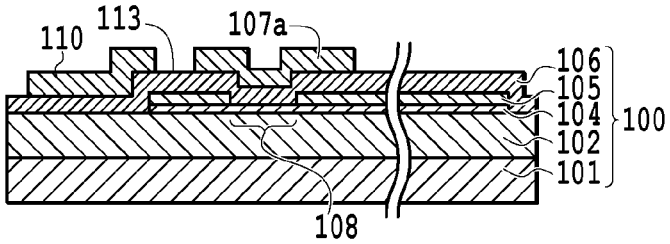
FIG.8E
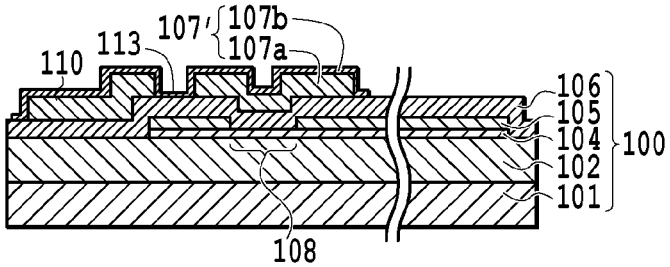
FIG.8F
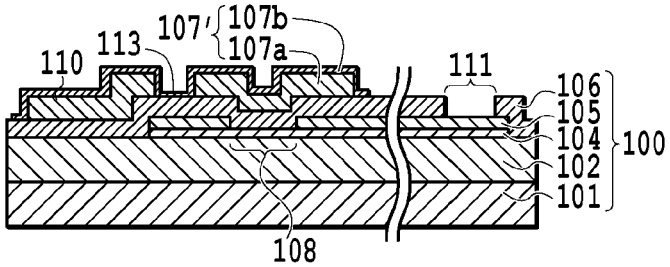
FIG.8G
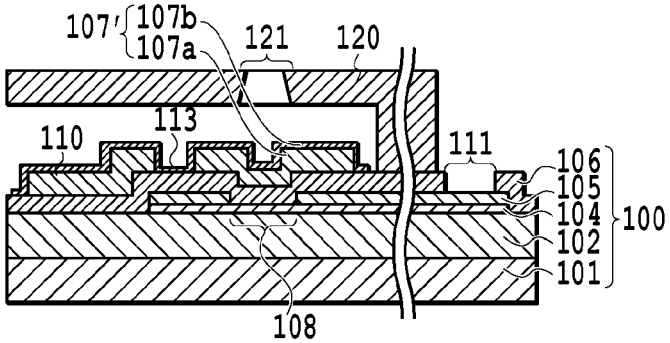

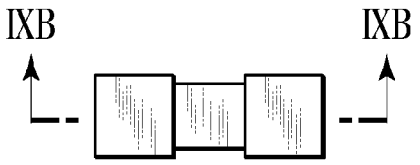
FIG.9A
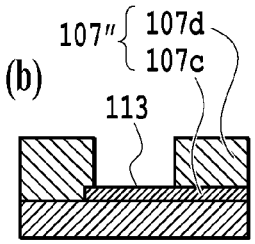
FIG.9B
FIG.9C
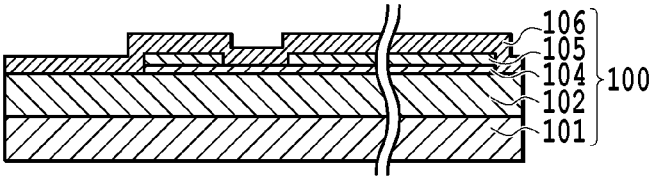
FIG.9D
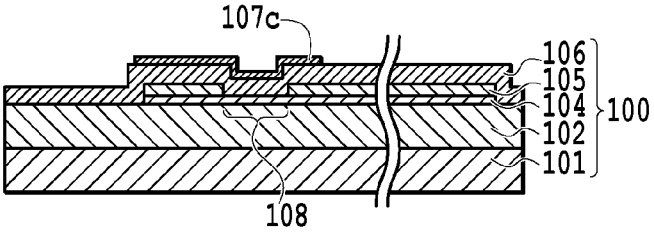
FIG.9E
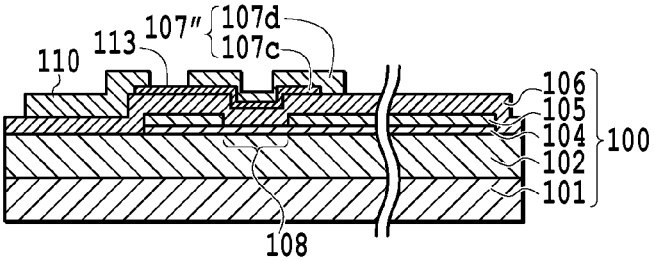
FIG.9F
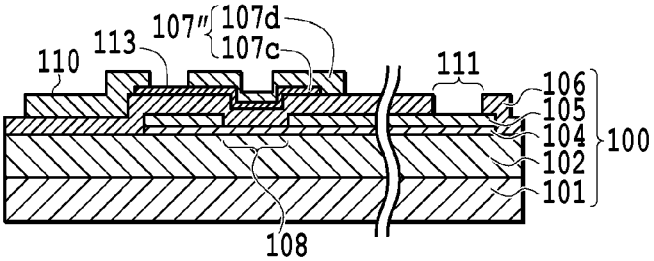
FIG.9G
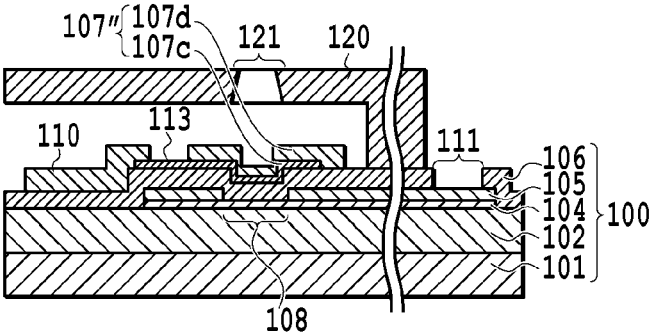

SUBSTRATE FOR INKJET HEAD AND INKJET HEAD HAVING PROTECTION LAYER INCLUDING INDIVIDUAL SECTIONS CORRESPONDING TO HEATING RESISTORS

BACKGROUND OF THE INVENTION

1. Field of the Invention

The present invention relates to a substrate for an inkjet head for printing a print medium by ejecting ink and an inkjet head.

2. Description of the Related Art

At present, there is widely used an inkjet printing apparatus wherein ink in liquid chambers is heated by energizing heating resistors, whereby film boiling in the heated ink causes foaming in the ink, and its foaming energy causes ink droplets to be ejected from ejection ports. During the printing by such an inkjet printing apparatus, some regions of the heating resistors are occasionally affected by physical action such as the impact of cavitation caused by ink foaming, shrinkage, and defoaming in the regions of the heating resistors. Moreover, since the heating resistors are kept at a high temperature during the ejection of ink, some regions of the heating resistors are occasionally affected by chemical action such as adhesion and deposition of ink components to and on the surfaces of the heating resistors. To protect the heating resistors from the physical action or the chemical action, a protection layer is occasionally disposed over the heating resistors to cover the heating resistors.

Generally, the protection layer is disposed at a position where the protection layer contacts ink. Accordingly, in a case where electricity flows through the protection layer, an electrochemical reaction occasionally occurs between the protection layer and ink, thereby damaging the function of the protection layer. In order to prevent this, an insulating layer is disposed between the heating resistor and the protection layer so that part of the electricity supplied to the heating resistor does not flow through the protection layer.

However, there is a case where the function of the insulating layer is damaged for some reason and electricity directly flows from the heating resistor or wiring to the protection layer, thereby causing a short circuit. In a case where part of the electricity supplied to the heating resistor flows through the protection layer, an electrochemical reaction occasionally occurs between the protection layer and ink, thereby degenerating the protection layer. In a case where the protection layer is disposed across the plurality of heating resistors, the entire protection layer may be affected.

Accordingly, it is considered that individual sections of the protection layer provided to correspond to the plurality of heating resistors and a common section of the protection layer commonly connecting the individual sections are connected by fuse sections provided on part of the protection layer. With the fuse sections provided on part of the protection layer, in a case where a current flows through the protection layer, an electrical connection can be cut so that the current is prevented from flowing through the other part of the protection layer.

Japanese Patent No. 3828728 discloses an example of an inkjet head in which a fuse section forms a part of the inkjet head. Japanese Patent No. 3828728 discloses a fuse for dissipating charge on a protection layer to other portions and cutting the electrical connection between the protection layer and a positive voltage pad at predetermined timing in order to reduce the impact of electrostatic discharge (ESD) on a print system in case that the electrostatic discharge is occurred.

However, Japanese Patent No. 3828728 discloses using a field effect transistor (FET) as the fuse provided between the protection layer and the positive voltage pad in the inkjet head. Japanese Patent No. 3828728 further discloses that the fuse is destroyed at predetermined timing, thereby cutting the electrical connection between the protection layer and the positive voltage pad. In this case, a relatively large energy is required for cutting the electrical connection between the protection layer and the positive voltage pad. Accordingly, part of the current flows from the protection layer to other portions before the fuse cuts the electrical connection, which occasionally affects other regions around the protection layer.

SUMMARY OF THE INVENTION

The present invention has been made to solve the above problems, and it is an object of the present invention to provide a substrate for an inkjet head and an inkjet head for reliably cutting an electrical connection to portions around a protection layer when the protection layer of heating resistors is energized.

According to the present invention, a substrate for an inkjet head comprising: a base; a plurality of heating resistors being disposed on the base and producing heat for heating ink in a case where the heating resistors are energized; a first protection layer being disposed closer to a top surface than the heating resistors and being capable of passing electricity; and a second protection layer disposed between the first protection layer and the heating resistors, the second protection layer electrically insulating the first protection layer from the heating resistors, wherein the first protection layer includes individual sections provided at positions corresponding to the plurality of heating resistors, and a common section which commonly connects the individual sections, and the individual sections and the common section are connected via connect sections which are eluted in a case where an electrochemical reaction occurs between the connect sections and ink so that an electrical connection between the individual sections and the common section is cut.

According to the present invention, a substrate for an inkjet head comprising: a base; a plurality of heating resistors being disposed on the base and producing heat for heating ink in a case where the heating resistors are energized; a first protection layer being disposed closer to a top surface than the heating resistors and being capable of passing electricity; and a second protection layer being disposed between the first protection layer and the heating resistors, the second protection layer electrically insulating the first protection layer from the heating resistors, wherein the first protection layer includes individual sections provided at positions corresponding to the plurality of heating resistors, and a common section which commonly connects the individual sections, and the individual sections and the common section are connected via connect sections which include at least one of Ir and Ru.

According to the present invention, an inkjet head comprising: a substrate for an inkjet head comprising: a base; a plurality of heating resistors being disposed on the base and producing heat for heating ink in a case where the heating resistors are energized; a first protection layer being disposed closer to a top surface than the heating resistors and being capable of passing electricity; and a second protection layer being disposed between the first protection layer and the heating resistors, the second protection layer electrically insulating the first protection layer from the heating resistors; a flow path forming member attached closer to the top surface of the substrate for the inkjet head and having ejection ports;

and a plurality of liquid chambers defined by the flow path forming member and the substrate for the inkjet head and being capable of storing ink therein, each of the plurality of liquid chambers including one of the heating resistors; wherein the first protection layer includes individual sections which correspond to the plurality of heating resistors and are exposed inside the liquid chambers, and a common section which commonly connects the individual sections, and the individual sections and the common section are connected via connect sections which are formed at positions where the connect sections contact ink in a case where the ink is stored inside the liquid chambers and which are eluted in a case where an electrochemical reaction occurs between the connect sections and ink so that an electrical connection between the individual sections and the common section is cut.

According to the present invention, an inkjet head comprising: a substrate for an inkjet head comprising: a base; a plurality of heating resistors being disposed on the base and producing heat for heating ink in a case where the heating resistors are energized; a first protection layer being disposed closer to a top surface than the heating resistors and being capable of passing electricity; and a second protection layer being disposed between the first protection layer and the heating resistors, the second protection layer electrically insulating the first protection layer from the heating resistors; a flow path forming member attached closer to the top surface of the substrate for the inkjet head and having ejection ports; and a plurality of liquid chambers defined by the flow path forming member and the substrate for the inkjet head and being capable of storing ink therein, each of the plurality of liquid chambers including one of the heating resistors; wherein the first protection layer includes individual sections which correspond to the plurality of heating resistors and are exposed inside the liquid chambers, and a common section which commonly connects the individual sections, and the individual sections and the common section are connected via connect sections which are formed at positions where the connect sections contact ink in a case where the ink is stored inside the liquid chambers and which include at least one of Ir and Ru.

Even when a small amount of current passes through the protection layer of the heating resistors, it is possible to reliably cut the electrical connection to portions around the protection layer, and therefore it is possible to certainly prevent the portions around the protection layer from being affected by the current flowing therethrough.

Further features of the present invention will become apparent from the following description of exemplary embodiments with reference to the attached drawings.

BRIEF DESCRIPTION OF THE DRAWINGS

FIGS. 8A and 8B are a plan view and a cross-sectional view, respectively, of a thin film region of an inkjet head according to a second embodiment;

FIGS. 8C to 8G are cross-sectional views of an inkjet head for explaining a manufacturing process;

FIGS. 9A and 9B are a plan view and a cross-sectional view, respectively, of a thin film region of an inkjet head according to a third embodiment; and FIGS. 9C to 9G are cross-sectional views of an inkjet head for explaining a manufacturing process.

DESCRIPTION OF THE EMBODIMENTS

Hereinafter, descriptions will be given of an inkjet printing apparatus and an inkjet head according to embodiments of the present invention with reference to the drawings.

Figure 1:
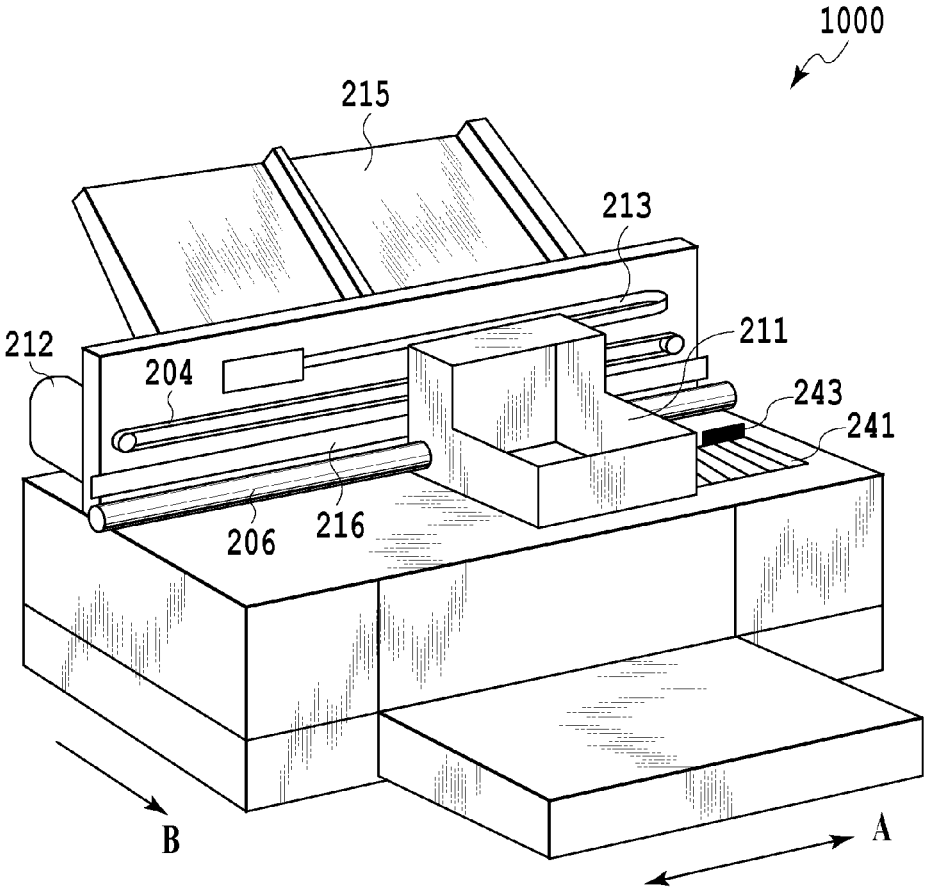
FIG. 1 is a perspective view of an inkjet printing apparatus according to an embodiment of the present invention.

FIG. 1 is a perspective view of an inkjet printing apparatus 1000 according to an embodiment of the present invention. The inkjet printing apparatus 1000 shown in FIG. 1 includes a carriage 211 in which an inkjet head unit 410 is mounted. In the inkjet printing apparatus 1000 of the present embodiment, the carriage 211 is guided along a guide shaft 206 so that the carriage 211 can move in a main scanning direction shown by an arrow A. The guide shaft 206 is disposed to extend in a width direction of a print medium. Accordingly, an inkjet head mounted in the carriage 211 performs printing while scanning in a direction crossing a conveying direction in which the print medium is conveyed. As described, the inkjet printing apparatus 1000 is a so-called serial-scan type inkjet printing apparatus which prints an image by moving an inkjet head 1 in the main scanning direction and conveying a print medium in a sub-scanning direction.

The carriage 211 is penetrated and supported by the guide shaft 206 to scan in a direction perpendicular to the conveying direction of the print medium. A belt 204 is attached to the carriage 211 and a carriage motor 212 is attached to the belt 204. This allows the driving force of the carriage motor 212 to be transmitted to the carriage 211 through the belt 204, whereby the carriage 211 can move in the main scanning direction while guided by the guide shaft 206.

A flexible cable 213 for transferring an electrical signal from a control unit, which will be described later, to the inkjet head in the inkjet head unit is attached to the carriage 211 so as to be connected to the inkjet head unit. The inkjet printing apparatus 1000 includes a cap 241 and a wiper blade 243 used for performing recovery processing on the inkjet head. The inkjet printing apparatus 1000 further includes a sheet feeding section 215 which stores print media in a stack and an encoder sensor 216 for optically capturing a position of the carriage 211.

The carriage 211 reciprocates in the main scanning direction by a driving force transmission mechanism including a carriage motor and a belt or the like for transmitting its driving force. The inkjet head unit 410 is mounted in the carriage 211.

In the carriage 211, a plurality of inkjet head units 410 compatible with the type of ink that the inkjet printing apparatus can eject is mounted. After loaded in the sheet feeding section 215, a print medium is conveyed by a conveyance roller in the sub-scanning direction shown by an arrow B. The inkjet printing apparatus 1000 sequentially prints an image on the print medium by repeating a printing operation of ejecting ink while moving the inkjet head in the main scanning direction and a conveying operation of conveying the print medium in the sub-scanning direction.

Figure 2A:
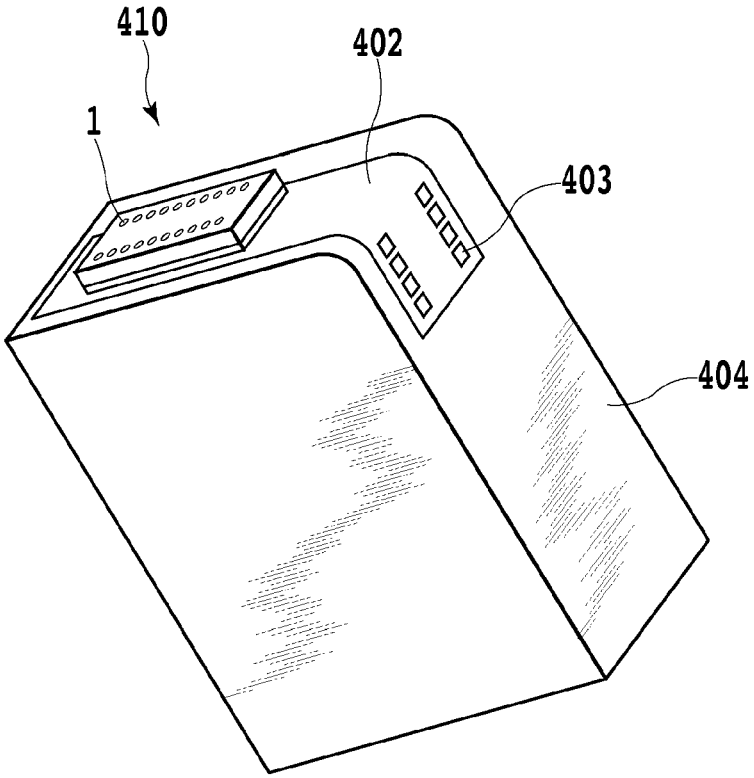
FIG. 2A is a perspective view of an inkjet head unit provided for the inkjet printing apparatus of FIG. 1.

FIG. 2A is a perspective view of the inkjet head unit 410. The inkjet head unit 410 is in the form of a cartridge in which the inkjet head is integral with an ink tank. The inkjet head unit 410 can be mounted in and demounted from the carriage. The inkjet head 1 is attached to the inkjet head unit 410. A tape member 402 for Tape Automated Bonding (TAB) having a terminal for supplying power is attached to the inkjet head unit 410. Power is selectively supplied from the inkjet printing apparatus to its heat action sections 117 through the tape member 402.

In a case where power is supplied to the heat action sections 117, the power is supplied from contacts 403 to the inkjet head 1 through the tape member 402. The inkjet head unit 410 has an ink tank 404 which temporarily stores ink and supplies the ink to the inkjet head 1.

Figure 2B:
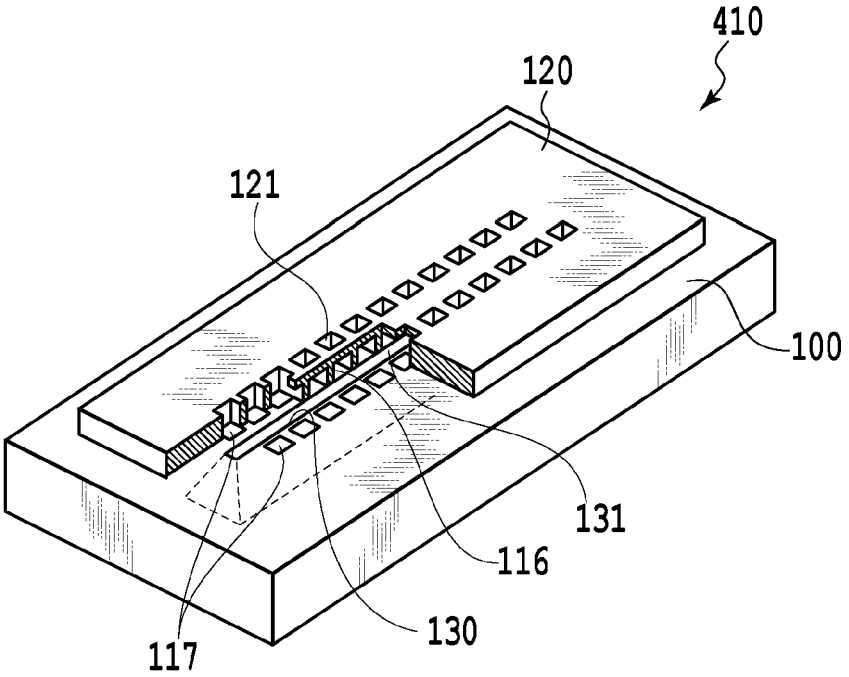
FIG. 2B is a cutaway perspective view of an inkjet head mounted in the inkjet head unit of FIG. 2A.

FIG. 2B is a cutaway perspective view of the inkjet head unit 410. In the inkjet head 1 of the present embodiment, a flow path forming member 120 is attached to a substrate 100 for the inkjet head. Between the flow path forming member 120 and the substrate 100 for the inkjet head, there is defined a plurality of liquid chambers 132 capable of storing ink therein. In the substrate 100 for the inkjet head, there is formed an ink supply port 130 penetrating the substrate 100 for the inkjet print head. In the flow path forming member 120, there is formed a common liquid chamber 131 which is in communication with the ink supply port 130. Further, in the flow path forming member 120, there are formed ink flow paths 116 so as to extend from the common liquid chamber 131 to the liquid chambers 132. Accordingly, the flow path forming member 120 is formed such that the common liquid chamber 131 is in communication with the liquid chambers 132 via the ink flow paths 116. The heat action sections 117 are formed inside the liquid chambers 132. Ejection ports 121 are formed at positions corresponding to the heat action sections 117 in the flow path forming member 120.

In a case where ink is supplied from the ink tank 404 to the inkjet head 1, the ink is supplied to the common liquid chamber 131 through the ink supply port 130 of the substrate 100 for the inkjet head. The ink supplied to the common liquid chamber 131 is supplied to the liquid chambers 132 through the ink flow paths 116. On this occasion, capillary action causes the ink in the common liquid chamber 131 to be supplied to the ink flow paths 116 and the liquid chambers 132, and a meniscus is formed at the ejection ports 121, whereby the liquid level of ink can be stably held.

In the liquid chambers 132, the heat action sections 117 have heating resistors 108, and in order to eject ink, the heating resistors 108 are energized through wiring. The energizing of the heating resistors 108 generates a thermal energy in the heating resistors 108. As a result, the ink in the liquid chambers 132 is heated and film boiling causes foaming, and its foaming energy causes ink droplets to be ejected from the ejection ports 121.

Incidentally, the inkjet head 1 is not limited to the form of the above unit of the present embodiment in which the inkjet head is integral with the ink tank. For example, the inkjet head may be separated from the ink tank. Accordingly, in a case where the remaining amount of ink in the ink tank reaches zero, only the ink tank is demounted from the carriage and a new ink tank is mounted, so that only the ink tank is replaced. Since it is not always necessary to replace the inkjet head along with the ink tank, replacement frequency of the inkjet head can be decreased. Accordingly, it is possible to reduce the operating cost of the inkjet printing apparatus.

Alternatively, the inkjet printing apparatus may have a structure in which the inkjet head and the ink tank are disposed at separate positions and they are connected using a tube or the like so that ink is supplied to the inkjet head. Although the inkjet printing apparatus of the present embodiment is applied to a serial-scan type inkjet printing apparatus in which a print head scans in a main scanning direction A, the present invention is not limited to this. The present invention is also applicable to a full-line type inkjet printing apparatus using an inkjet head which extends the entire width of a print medium, like the one applied to a line printer.

Figure 3A:
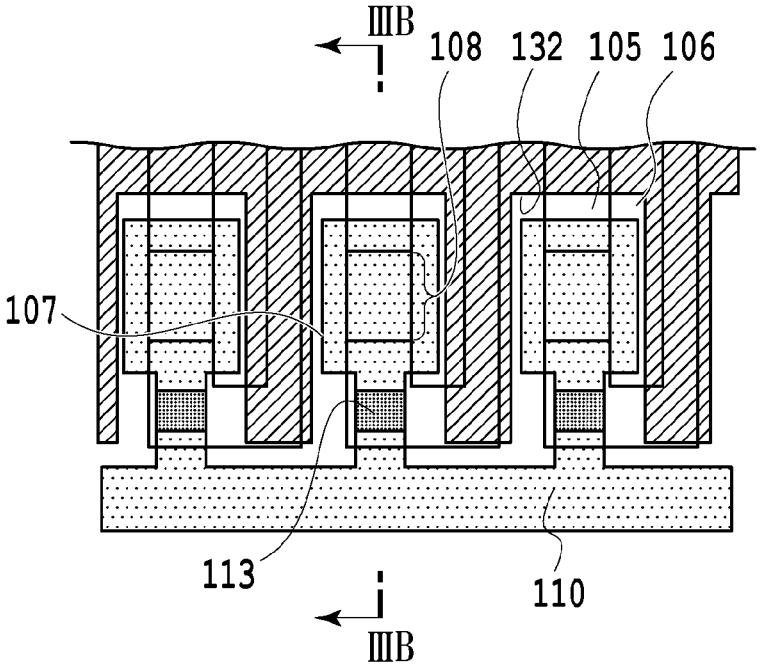
FIG. 3A is an enlarged cross-sectional view of a portion around heating resistors of the inkjet head of FIG. 2B, as viewed in an ink ejecting direction.
Figure 3B:
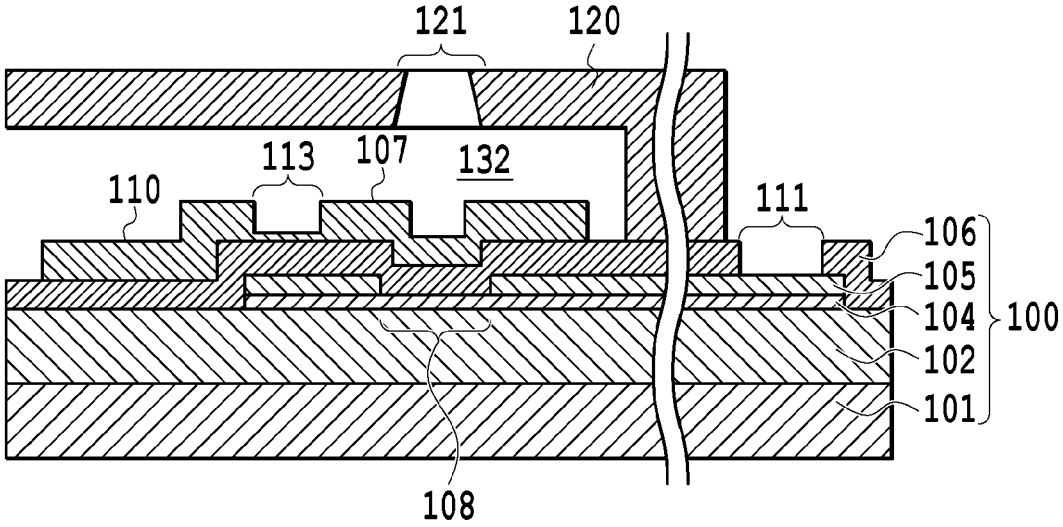
FIG. 3B is a cross-sectional view taken along line IIIB-IIIB of FIG. 3A.

FIGS. 3A and 3B are cross-sectional views of the inkjet head 1. FIG. 3A is a schematic cross-sectional view of a portion around the heat action sections of the substrate 100 for the inkjet head according to a first embodiment of the present invention, as viewed from the top. FIG. 3B is a schematic cross-sectional view taken from line IIIB-IIIB of FIG. 3A.

As shown in FIGS. 3A and 3B, in the inkjet head 1, the substrate 100 for the inkjet head consisting of a plurality of layers laminated on a base 101 formed by silicon is formed. In the present embodiment, a heat accumulating layer 102 made of a thermally-oxidized film, a SiO film, a SiN film, or the like is disposed on the base 101. A heating resistor layer 104 is disposed on the heat accumulating layer 102 and an electrode wiring layer 105 is disposed on the heating resistor layer 104 as wiring made of a metal material such as Al, Al—Si, or Al—Cu. A protection layer (second protection layer) 106 is disposed on the electrode wiring layer 105. The protection layer 106 is provided above the heating resistor layer 104 and the electrode wiring layer 105 so as to cover them. The protection layer 106 is made of a SiO film, a SiN film, or the like and functions as an insulating layer.

An upper protection layer (first protection layer) 107 is disposed on the protection layer 106. The upper protection layer 107 protects surfaces of the heating resistors 108 from chemical action and physical impact caused by heat of the heating resistors 108. In the present embodiment, the upper protection layer 107 is made of a platinum group such as iridium (Ir) or ruthenium (Ru), or tantalum (Ta). Further, the upper protection layer 107 made of such materials has electrical conductivity. When ink is ejected, top of the upper protection layer 107 is in contact with the ink and kept in a severe environment where the temperature of the ink on the top of the upper protection layer 107 rises instantly, causing ink foaming, whereby defoaming and cavitation occur. Accordingly, in the present embodiment, the upper protection layer 107, formed with a material which has excellent corrosion resistance and reliability, is formed at positions corresponding to the heating resistors 108.

The heating resistors 108 as electrothermal transducing elements are formed by partially removing the electrode wiring layer 105. In the present embodiment, the heating resistor layer 104 and the electrode wiring layer 105 are laminated and disposed in substantially the same form in a direction from the ink supply port to the liquid chamber 132. By partially removing the electrode wiring layer 105, a gap is formed in the removed part of the electrode wiring layer 105, where only the heating resistor layer 104 is disposed. Accordingly, while forming two layers: the heating resistor layer 104 and the electrode wiring layer 105, the electrode wiring layer 105 is removed only at portions corresponding to the portions which function as the heating resistors 108. The electrode wiring layer 105 is connected to a driving element circuit or an external power supply terminal which are not shown in the figures and can receive power from the outside. Incidentally, in the above embodiment, the electrode wiring layer 105 is disposed on the heating resistor layer 104, but the present invention is not limited to this. It is possible to form the electrode wiring layer 105 on the base 101 or the thermally-oxidized film 102, partially remove the electrode wiring layer 105 to form a gap, and dispose the heating resistor layer 104 on the electrode wiring layer 105.

The upper protection layer 107 formed at position corresponding to the heating resistor 108 inside the liquid chamber 132 extends from a portion inside the liquid chamber 132 toward a portion in which an ink supply port is formed. Outside the liquid chamber 132, the upper protection layer 107 is joined and connected with another upper protection layer 107 which extends from another liquid chamber. In the present embodiment, a common section (common wiring section) 110 which is a portion that the upper protection layers 107 extending from respective liquid chambers 132 toward the ink supply port are connected is formed along an ejection port array. Portions of the common section 110 extending from the liquid chambers 132 are merged into one outside the liquid chambers 132, and then, the common section 110 is disposed as wiring (connection wiring section). The wiring that the common sections 110 are joined is connected to an external electrode (external electrode section) 111. Incidentally, the common section 110 is made of the same layer as the upper protection layer 107. More specifically, the upper protection layer 107 includes individual sections provided corresponding to the heating resistors 108 and the common section 110 which commonly connects the individual sections. Hereinafter, the individual section corresponding to the heating resistor 108 is also referred to as the upper protection layer 107.

In the upper protection layer 107 disposed in the liquid chambers 132, thin film regions (connect sections) 113 having a small thickness are formed between portions corresponding to the heating resistors 108 and the common section 110. Herein, the upper protection layer 107, the thin film regions 113, and the common section 110 are made of the same material. More particularly, the upper protection layer 107, the thin film regions 113, and the common section 110 are made of Ir, Ru, or an alloy including either Ir or Ru. Incidentally, as described above, the upper protection layer 107, the thin film regions 113, and the common section 110 may be made of Ta.

Figure 4A:
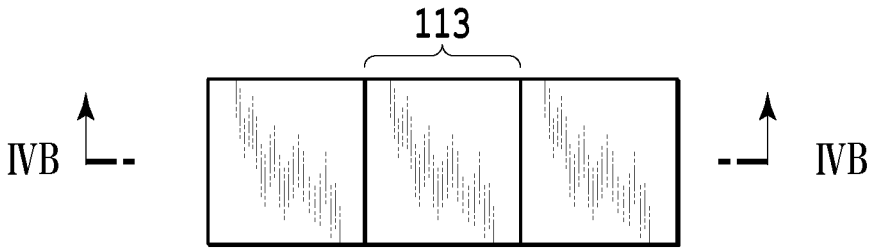
FIG. 4A is an enlarged plan view of a thin film region of the inkjet head of FIGS. 3A and 3B, as viewed in an ink ejecting direction.
Figure 4B:
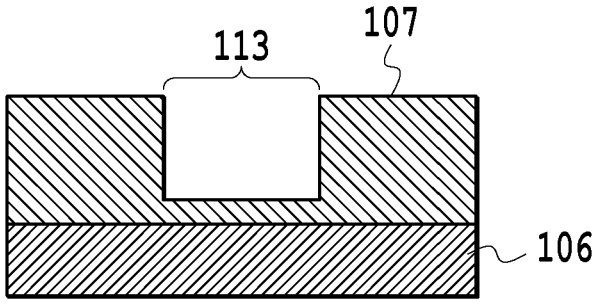
FIG. 4B is a cross-sectional view taken along line IVB-IVB of FIG. 4A.

FIG. 4A is a schematic plan view of the thin film region 113. FIG. 4B is a schematic cross-sectional view of the thin film region 113 taken along line IVB-IVB of FIG. 4A. The thin film region 113 in the upper protection layer 107 is formed in a region which comes into contact with ink in the upper protection layer 107. In the present embodiment, the upper protection layer 107 has substantially uniform thickness on the whole, and a portion of the upper protection layer 107 having a smaller thickness is formed to be the thin film region 113.

The portion of the thin film region 113 in the upper protection layer 107 is formed to have a relatively large thickness in the range of 200 to 500 nm in order to achieve a long life even under the physical impact and chemical action such as cavitation on a surface. In contrast, the thin film region 113 is formed to have a small thickness in the range of 10 to 100 nm.

(Circuit Configuration)

Figure 5A:
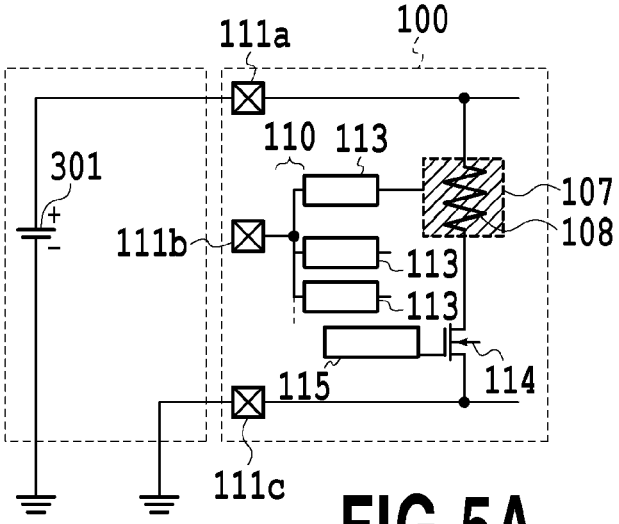
FIGS. 5A to 5C are circuit diagrams illustrating a state in which ink is ejected, a state in which a test is performed, and a state in which a short circuit is generated, respectively, in the inkjet head of FIGS. 3A and 3B.
Figure 5B:
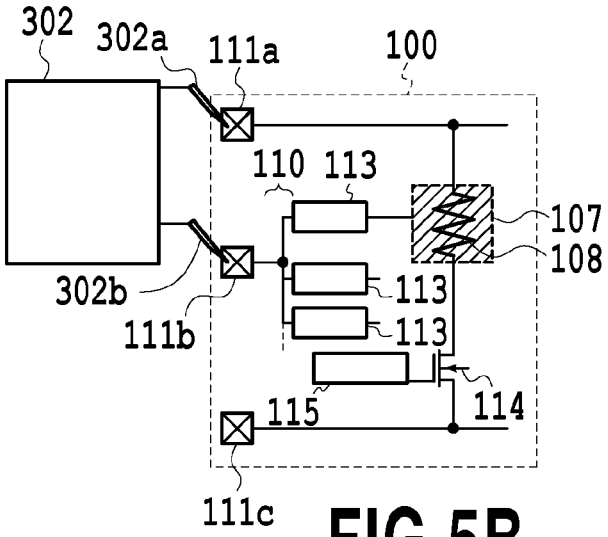
Figure 5C:
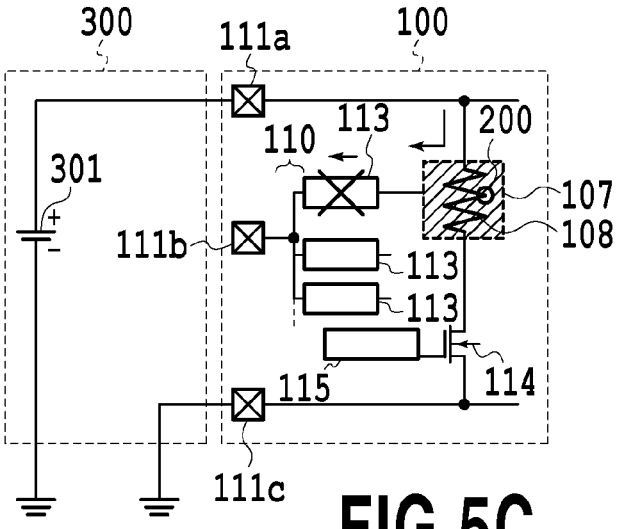

FIGS. 5A to 5C are circuit diagrams showing the states of the inkjet head 1 according to the present embodiment. FIG. 5A is a circuit diagram of the inkjet head 1 in a case where normal printing is performed. The heating resistors 108 are selectively driven by a power supply 301, a switching transistor 114, and a selection circuit 115. In the present embodiment, the power supply 301 has a voltage of 20 to 35 V. The power supply 301 as used herein has a voltage of 24 V. In this configuration, the power supply 301 can supply power to the heating resistors 108 at predetermined timing and the ejection ports can eject ink droplets at predetermined timing.

Since the protection layer 106 which functions as an insulating layer is disposed between the heating resistors 108 and the upper protection layer 107, the heating resistors 108 and the upper protection layer 107 are not electrically connected. The upper protection layer 107 is connected to the common section 110 via the thin film regions 113. The common section 110 is connected to the external electrode.

FIG. 5B is a circuit diagram of the inkjet head 1 at the time of a test for the insulation properties of the protection layer 106 which functions as an insulating layer. The test for the insulation properties of the protection layer 106 is performed under the condition that the inkjet head 1 does not include ink, like prior to shipment. A measurement device 302 for checking the insulation properties of the protection layer 106 is disposed to be connected to an electrode 111*a* provided for the wiring for supplying power to the heating resistors 108 and an electrode 111*b* provided for the wiring connected to the common section 110. The measurement device 302 includes probe pins (needles) 302*a* and 302*b*. The probe pins 302*a* and 302*b* are connected to the electrodes 111*a* and 111*b*, respectively, and in a case where a current flows between the electrode 111*a* and the electrode 111*b*, the current can be detected. In a case where no current is detected between the electrode 111*a* and the electrode 111*b*, it is determined that the insulation properties of the protection layer 106 are ensured. In a case where a current is detected between the electrode 111*a* and the electrode 111*b*, it is determined that the insulation properties of the protection layer 106 are degraded and part of the current supplied to the heating resistors 108 is flowing through the upper protection layer 107.

In the inkjet head 1, an electrode 111*c* is provided for the wiring extending from the switching transistor 114. The probe pins 302*a* and 302*b* are connected to the electrodes 111*a* and 111*c*, respectively, to detect a current flowing between the electrode 111*a* and the electrode 111*c* so that it is determined whether the heating resistors 108 and the switching transistor 114 function normally. In the test, measurement is made of a flowing current by applying a voltage which is equal to or higher than the actually applied one between the upper protection layer 107 and the heating resistors 108 or between the upper protection layer 107 and the electrode wiring layer 105. In the test, since the upper protection layer 107 and the thin film regions 113 do not contact ink, an electrochemical reaction such as anodic oxidation via ink does not occur in the upper protection layer 107 even if a voltage is applied. Accordingly, it is possible to reliably measure a current regarding presence or absence of a leak current between the upper protection layer 107 and the heating resistors 108 and/or between the upper protection layer 107 and the electrode wiring layer 105.

The anodic oxidation of the upper protection layer 107 caused by a current flowing through the upper protection layer 107 often occurs at the time of manufacturing the inkjet head 1 in a case where a pinhole or the like is formed in the protection layer 106 having insulation properties, which causes the insulation properties to be degraded. Therefore, it is preferable to check whether or not the insulation properties of the protection layer 106 are ensured at the time of manufacturing. It is appropriate to perform this test for checking the insulation properties after the upper protection layer 107 is formed and then the external electrode 111 to which electricity is applied is formed.

During the process of printing, there is a case where a short circuit occurs for some reason and a current flows between the electrode wiring layer 105 and the upper protection layer 107. FIG. 5C shows a circuit of the inkjet head 1 in a case where the short circuit occurs between the electrode wiring layer 105 and the upper protection layer 107 and causes part of the current to flow through the electrode wiring layer 105 toward the thin film regions 113.

As shown by arrows in FIG. 5C, in a case where a short circuit occurs between the electrode wiring layer 105 and the upper protection layer 107, a current flowing toward the thin film regions 113 is generated.

For example, in a case where one of the heating resistors 108 is damaged, the protection layer 106 may be broken by the impact of the damage. Then, the heating resistor layer 104 and the upper protection layer 107 may be partially eluted and directly contact with each other, thus causing a short circuit 200. In a case where such a short circuit occurs, a voltage may be applied across the upper protection layer 107. Accordingly, in a case where the upper protection layer 107 is made of Ta, the anodic oxidation of the upper protection layer 107 occurs by an electrochemical reaction with ink. If the anodic oxidation proceeds, the oxidized Ta is eluted into the ink, thereby reducing the life of the upper protection layer 107. In a case where the upper protection layer 107 is made of Ir or Ru, the upper protection layer 107 is eluted into ink by the electrochemical reaction between the upper protection layer 107 and the ink, thereby decreasing the durability of the upper protection layer 107.

On this occasion, since a voltage is applied across the entire upper protection layer 107 via the common section 110, the short circuit may also have the impact on the inside of the other liquid chambers. Accordingly, the decrease in durability of the upper protection layer 107 caused by the anodic oxidation or the electrochemical reaction with the ink widely affects the inkjet head 1, thereby increasing the impact of the short circuit.

In the present embodiment, the thin film region 113 is formed between the upper protection layer 107 and the common section 110. Therefore, in a case where a short circuit occurs between the electrode wiring layer 105 and the upper protection layer 107 and a current flows through the upper protection layer 107, electricity flows also through the thin film region 113. On this occasion, the upper protection layer 107 and the thin film region 113 are in contact with ink, and the upper protection layer 107 is made of a platinum group or Ta. Accordingly, as described above, when a current flows through the upper protection layer 107 and in a case where the upper protection layer 107 is made of Ta, the anodic oxidation of the upper protection layer 107 occurs by an electrochemical reaction with ink and the upper protection layer 107 is eluted into the ink. In a case where the upper protection layer 107 is made of a platinum group such as Ir or Ru, the upper protection layer 107 is eluted into ink by the electrochemical reaction between the upper protection layer 107 and the ink. In a case where the ink is stored inside the liquid chambers 132 and the heating resistors 108 are energized and driven, an electric potential of the ink is lower than a driving potential of the heating resistors 108. Therefore, in a case where electricity flows through the upper protection layer 107 when a short circuit occurs between the electrode wiring layer 105 and the upper protection layer 107, an electrochemical reaction easily occurs between the upper protection layer 107 and the ink.

In this manner, in a case where a current flows through the upper protection layer 107 while the ink stored in the inkjet head 1, the upper protection layer 107 is partially eluted into the ink. When a current flows through the upper protection layer 107, the current also flows through the thin film regions 113. The thin film regions 113 are formed to be thin so as to be easily cut when eluted. Therefore, when the current flows through the upper protection layer 107, the thin film regions 113 are relatively easily cut and an electrical connection between the heating resistor 108 and the common section 110 is relatively easily cut. In this manner, the thin film regions 113 are preferentially cut when the electricity flows therethrough and the electrical connection between the upper protection layer 107 and the common section 110 is relatively easily cut.

Moreover, the thin film region 113 is formed between the heating resistor 108 and the common section 110. The thin film region 113 is formed in the entire width of a portion connecting the heating resistor 108 and the common section 110. Accordingly, the thin film region 113 is disposed so that in a case where it is eluted, the electrical connection between the heating resistor 108 and the common section 110 is reliably cut.

In this manner, in the present embodiment, in a case where a current flows through the upper protection layer 107, the thin film regions 113 are formed so as to be easily cut by an electrochemical reaction with ink to cut the electrical connection. In the present embodiment, since the thin film regions 113 are cut by the electrochemical reaction to cut the electrical connection, a large energy is not required to cut the electrical connection and the electrical connection is relatively easily cut. Therefore, in a case where a current flows through the upper protection layer 107, the electrical connection between the heating resistor 108 and the common section 110 is reliably cut. In this manner, since the electrical connection is cut by the electrochemical reaction of the thin film regions 113, it is possible to improve the reliability as a fuse section for cutting the electrical connection. Accordingly, it is possible to suppress the impact of the current flowing through the upper protection layer 107 on the foaming in other liquid chambers and the ejection of ink droplets from ejection ports.

Since it is possible to suppress the impact on other liquid chambers, even in a case where an electrical short circuit occurs in one of the liquid chambers and this makes the liquid chamber unable to eject ink droplets, the other liquid chambers can cause ink to foam normally and eject ink normally. Therefore, it is possible to minimize the impact of the electrical short circuit caused in one of the liquid chambers. Accordingly, even in a case where the electrical short circuit occurs in one of the liquid chambers, it is possible to minimize the reduction of quality of a print image caused by the short circuit. Moreover, since the adjacent liquid chambers can eject ink normally even in a case where the electrical short circuit occurs in one of the liquid chambers, the ejection of ink droplets from the adjacent ejection ports makes it possible to relatively easily complement the ink droplets ejected from the ejection port having a short circuit. Moreover, even in a case where a short circuit occurs between the electrode wiring layer 105 and the upper protection layer 107 in one of the liquid chambers, it does not immediately require replacement of the inkjet head 1. Therefore, it is possible to use the inkjet head 1 for a long period of time and extend the life of the inkjet head 1. At the same time, the operating cost of the inkjet printing apparatus 1000 can be reduced.

If a fuse element formed by polysilicon is disposed between the upper protection layer 107 and the common section 110, it is necessary to cut the electrical connection by the polysilicon included in the fuse element with heat generated when a current flows through the fuse element. Generally, the polysilicon used for a fuse element has a melting point of about 1400° C. In order to cut the electrical connection by the fuse element, it is necessary to pass a large amount of current that generates heat equal to or higher than 1400° C. in the fuse element. In this manner, in order to cut the electrical connection by the fuse element, a relatively large energy is required. On the other hand, as described in the present embodiment, since the thin film regions 113 are eluted into ink by an electrochemical reaction, it is possible to cut the electrical connection between the upper protection layer 107 and the common section 110 having a short circuit, without requiring a large energy.

First Embodiment

A first embodiment of the present invention will be described.

<Layer Structure of Inkjet Head and Manufacturing Method Thereof>

A process for manufacturing the inkjet head of the first embodiment will be described. FIGS. 6A to 6F are schematic cross-sectional views for explaining the manufacturing process of the substrate 100 for the inkjet head according to the first embodiment. Further, FIGS. 7A to 7F are schematic plan views in the manufacturing process of the substrate 100 for the inkjet head.

Incidentally, normally in the manufacturing process of the inkjet head 1, the inkjet head 1 is manufactured in a manner that layers are laminated on the base 101 made of Si in a state in which a driving circuit is incorporated beforehand. A semiconductor element such as a switching transistor 114 for selectively driving the heating resistors 108 is incorporated beforehand into the base 101 as a driving circuit, and layers are laminated on the base 101 to form the inkjet head 1. For the sake of simplicity, however, a driving circuit incorporated beforehand or the like is not shown in the figures, and FIGS. 6 and 7 only show the base 101.

First, on the base 101, through the thermal oxidation method, the sputtering method, the CVD method, or the like, the heat accumulating layer 102 made of a $SiO_2$ thermally-oxidized film is formed as a lower layer below the heating resistor layer 104. Incidentally, regarding the base into which the driving circuit is incorporated beforehand, the heat accumulating layer can be formed during the process of manufacturing the driving circuit.

Figure 7A:
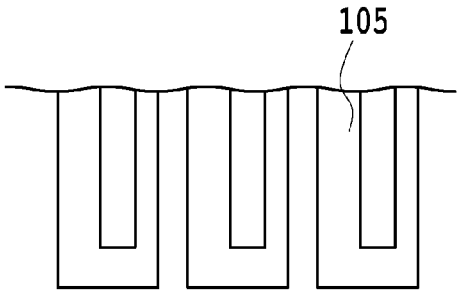
FIGS. 7A to 7F are cross-sectional views for explaining the process for manufacturing the inkjet head of the first embodiment, as viewed in an ink ejecting direction of the inkjet head in each step.

Then, the heating resistor layer 104 of TaSiN or the like is formed on the heat accumulating layer 102 by reactive sputtering so that the heating resistor layer 104 has a thickness of about 50 nm. Further, an Al layer is formed to have a thickness of about 300 nm on the heating resistor layer 104 by sputtering to form the electrode wiring layer 105. Then, dry etching is simultaneously performed on the heating resistor layer 104 and the electrode wiring layer 105 by using a photolithography method. A portion other than the heating resistor layer 104 and the electrode wiring layer 105 is removed accordingly, and the heating resistor layer 104 and the electrode wiring layer 105 having the shape shown in FIG. 7A are formed. Incidentally, in the present embodiment, a reactive ion etching (RIE) method is used as dry etching.

Figure 6A:
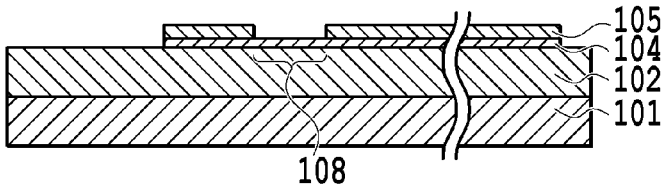
FIGS. 6A to 6F are cross-sectional views for explaining a process for manufacturing an inkjet head of a first embodiment, as viewed from a side of the inkjet head in each step.
Figure 7B:
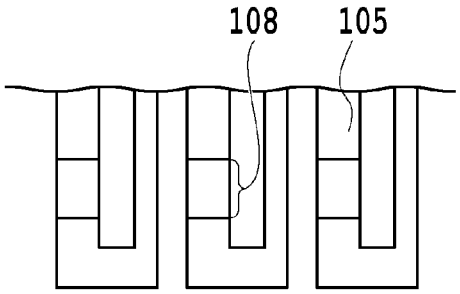

Next, in order to form the heating resistors 108, wet etching is performed by using the photolithography method again to partially remove the electrode wiring layer 105 made of Al and partially expose the heating resistor layer 104 as shown in FIGS. 6A and 7B. Incidentally, in order to achieve the excellent coverage properties of the protection layer 106 at ends of the electrode wiring layer 105, it is desirable to perform publicly-known wet etching for obtaining an appropriate tapered shape at the ends of the electrode wiring layer 105.

Figure 6B:
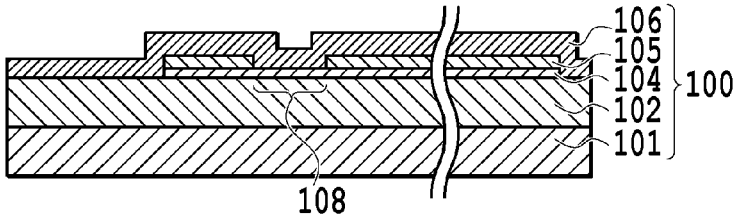
Figure 7C:
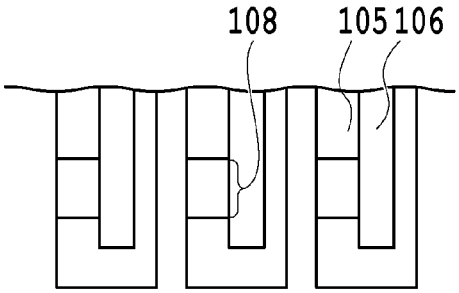

Thereafter, a SiN film as the protection layer 106 is formed to have a thickness of about 350 nm by the plasma CVD method as shown in FIGS. 6B and 7C.

Figure 6C:
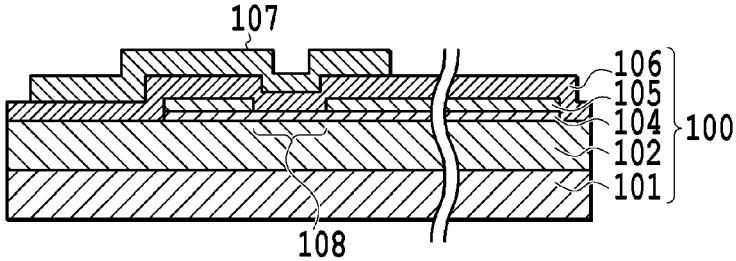
Figure 6D:
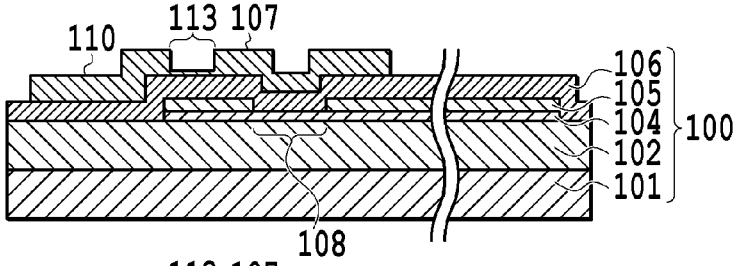
Figure 7D:
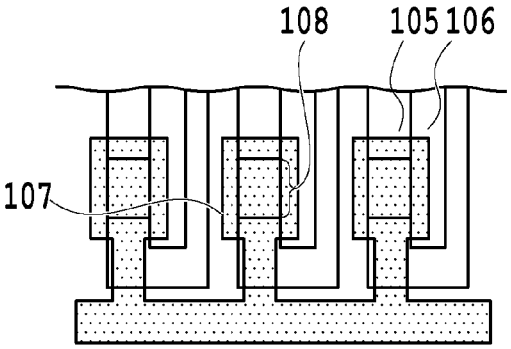
Figure 7E:
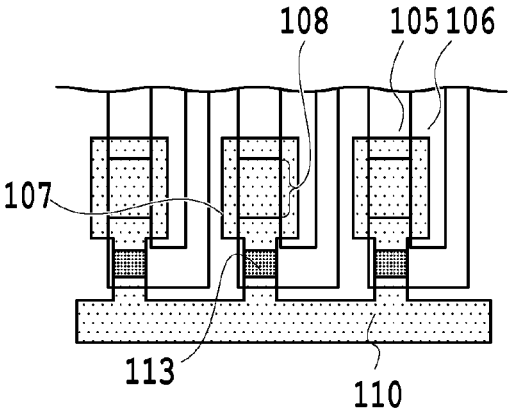

Next, a layer made of a platinum group as the upper protection layer 107 is formed on the protection layer 106 by sputtering so that the upper protection layer has a thickness of about 350 nm. The upper protection layer 107 is herein made of Ir or Ru. Next, dry etching is performed by the photolithography method to partially remove the upper protection layer 107 and obtain the shape of the upper protection layer 107 as shown in FIGS. 6C and 7D. In this stage, the upper protection layer 107 is formed on the regions of the heating sections 108, while the common section 110 is made of the same platinum material as the upper protection layer 107 and formed to connect the individual sections of the upper protection layer 107 formed inside the liquid chambers 132.

Next, dry etching is performed by the photolithography method only portions corresponding to the thin film regions 113 in the upper protection layer 107. On this occasion, etching is not performed on the entire upper protection layer 107 and the etching is stopped when the upper protection layer 107 is partially removed and the thickness of the thin film regions 113 reaches about 30 nm. Accordingly, the upper protection layer 107 is formed in a shape shown in FIGS. 6D and 7E. The thin film regions 113 are formed inside the liquid chambers 132 and the ink flow paths so that the thin film regions 113 directly contact ink in a case where the ink is contained in the inkjet head 1.

Figure 6E:
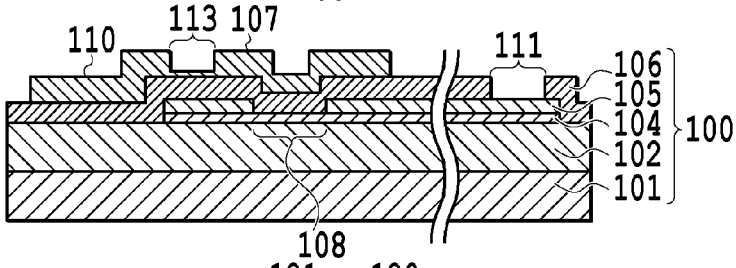

Next, in order to form the external electrode 111, dry etching is performed by the photolithography method to partially remove the protection layer 106 and partially expose a corresponding portion of the electrode wiring layer 105 as shown in FIG. 6E.

In the present embodiment, the upper protection layer 107 made of a material of a platinum group is subjected to half etching to reduce the thickness of the thin film regions 113 as shown in FIG. 4B. The upper protection layer 107 on the corresponding portions of the heating resistors 108 has a thickness of 350 nm which is large enough to achieve required durability. Meanwhile, the thin film regions 113 have a thickness of 30 nm so that in a case where the short circuit 200 occurs between the electrode wiring layer 105 and the upper protection layer 107, the thin film regions 113 are eluted into ink by the electrochemical reaction with ink until cut, and insulated from the common section 110.

On this occasion, regarding the portions formed to be thin by the half etching, only the thin film regions 113 may be thin or the entire common section 110 may also be formed to be thin. However, the common section 110 needs to efficiently pass a current in the case of performing a test or the like for checking the insulation properties of the protection layer 106. Accordingly, in the present embodiment, the common section 110 preferably has the same thickness as the upper protection layer 107 formed on the corresponding portions of the heating resistors 108, that is, 350 nm.

Figure 6F:
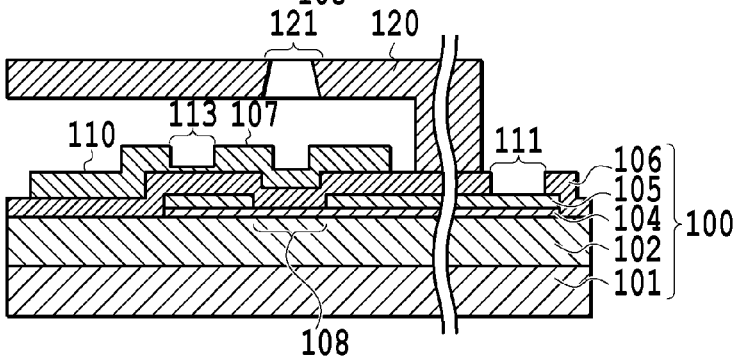
Figure 7F:
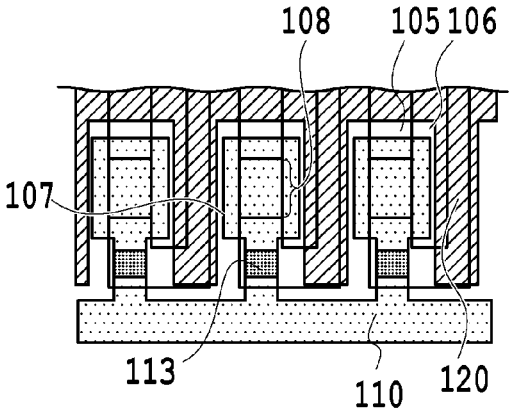

Next, as shown in FIGS. 6F and 7F, the flow path forming member 120 is disposed on the substrate 100 for the inkjet head while the ejection ports 121 are formed on the flow path forming member 120.

The inkjet head 1 is manufactured according to the above process.

According to the features of the present embodiment, in a case where a short circuit occurs between the electrode wiring layer 105 and the upper protection layer 107 and a current flows through the upper protection layer 107, a fuse is not blown but the thin film regions 113 are eluted into ink by the electrochemical reaction with ink to cut the electrical connection. Accordingly, the portion causing a current to flow through the upper protection layer 107 by the short circuit can be electrically separated from the upper protection layer 107 formed in the other liquid chambers. This can improve the reliability of the inkjet head 1 without requiring a large energy to cut the electrical connection as in the case of using fuse elements. Further, in a case where the electrical connection of the upper protection layer 107 is cut, the inkjet head 1 does not reach a high temperature as in the case of using fuse elements, and accordingly, it is possible to reduce the impact of heat on the inkjet head 1.

Incidentally, in the manufacturing of the inkjet head 1, a positive potential may be applied to the common section 110 via the external electrode 111 in a state in which the inkjet head 1 is filled with ink before shipment. In this stage, the thin film regions 113 inside all of the liquid chambers 132 may be eluted into ink to cut the electrical connection. By the time of shipment, a test or the like for checking the insulation properties of the protection layer 106 has often been completed. In this case, the subsequent stage will not enjoy the advantage that the upper protection layer 107 extending from the portion corresponding to heating resistors 108 inside the liquid chambers 132 is connected to the common section 110. Therefore, in this case, a positive potential may be applied to the common section 110, the thin film regions 113 inside the liquid chambers 132 may be eluted, and the electrical connection between the upper protection layer 107 inside the liquid chambers 132 and the common section 110 may be cut. In other words, the manufacturing process of the inkjet head 1 may include a step of severing the thin film regions 113, in a state that the liquid chambers 132 are filled with ink, by applying an electric potential to the electrode (external electrode section) 111*b* and eluting the thin film regions 113. The electric potential applied to the electrode 111*b* in the case of applying an electric potential to the electrode 111*b* is higher than the electric potential of ink. Accordingly, an electrochemical reaction easily occurs between the thin film regions 113 and the ink when an electric potential is applied to the electrode 111*b*. In this manner, the electrical connection between the upper protection layers 107 in the liquid chambers 132 is interrupted, and the electrical connection between the upper protection layers 107 in the liquid chambers 132 is cut. Accordingly, before the step of eluting the thin film regions 113, when a current is caused to flow through the heating resistors 108 via wiring, it is possible to perform the step of checking whether a short circuit which causes a current to flow is generated between the wiring and the upper protection layer 107. On this occasion, a test for checking for a short circuit is performed by using the electrode 111*a* of the power supply provided for the wiring (electrode section of the power supply) and the electrode 111*b*.

Second Embodiment

Next, an inkjet head of a second embodiment will be described.

FIGS. 8A to 8G illustrate a process for manufacturing an inkjet head according to the second embodiment. FIG. 8A is a plan view of a thin film region 113 of the inkjet head of the second embodiment. FIG. 8B is a cross-sectional view taken along line VIIIB-VIIIB of FIG. 8A.

In the inkjet head of the first embodiment, the upper protection layer 107 is formed as one layer. On the other hand, the inkjet head of the second embodiment is different from the inkjet head of the first embodiment in that an upper protection layer 107' consists of two layers. In the inkjet head of the second embodiment, the upper protection layer 107' includes a first upper protection layer 107*a* disposed at a lower position to have a thickness of 300 nm and a second upper protection layer 107*b* disposed at an upper position to have a thickness of 30 nm. Moreover, in the inkjet head of the second embodiment, a first upper protection layer 107*a* is made of Ir or Ru, and a second upper protection layer 107*b* is made of Ta. In the second embodiment, thin film regions 113 are formed such that one of the layers forming the upper protection layer 107' extends toward a common section 110.

FIGS. 8C to 8E are cross-sectional views of a substrate for the inkjet head in the steps of the process for manufacturing the inkjet head according to the second embodiment.

In the stage shown in FIG. 8C, the substrate for the inkjet head is the same as that shown in FIG. 6B of the first embodiment. Therefore, the steps to the stage shown in FIG. 8C of the process for manufacturing the substrate for the inkjet head are the same as those in the first embodiment.

Next, the first upper protection layer 107*a* is disposed on the protection layer 106. In this step, a Ta layer having a thickness of about 300 nm is formed as the first upper protection layer 107*a*. The first upper protection layer 107*a* is formed to have a predetermined thickness by sputtering.

Then, as shown in FIG. 8D, the first upper protection layer 107*a* is partially removed to form a portion to be the thin film region 113. In this step, dry etching is performed by using the photolithography method to remove a portion of the first upper protection layer 107*a* corresponding to the thin film region 113. Accordingly, the first upper protection layer 107*a* is formed to have a predetermined shape.

Then, the second upper protection layer 107*b* is disposed on the first upper protection layer 107*a*. In this step, the second upper protection layer 107*b* is formed to have a thickness of about 30 nm. Herein, the second upper protection layer 107*b* is formed over the entire first upper protection layer 107*a* to cover the first upper protection layer 107*a*. In the second embodiment, the second upper protection layer 107*b* is an Ir layer or a Ru layer. The second upper protection layer 107*b* is formed to have a predetermined thickness by sputtering.

Then, dry etching is performed by using the photolithography method to partially remove the upper protection layer 107*b* so that the second protection layer 107*b* has the shape shown in FIG. 8E. Accordingly, the upper protection layer 107*b* is formed to have a predetermined shape.

The subsequent step of forming the external electrode 111 (FIG. 8F) and step of forming the flow path forming member 120 (FIG. 8G) are performed in the same manner as in the first embodiment.

In the inkjet head manufactured by the above manufacturing process, the thin film regions 113 are formed by disposing only the second upper protection layer 107*b* in a portion which does not include the first upper protection layer 107*a*. First, the first upper protection layer 107*a* is precisely disposed at a predetermined position such that the first upper protection layer 107*a* is not disposed at the position of the thin film region 113, and then the second upper protection layer 107*b* is disposed over the entire portion around the heating resistors 108. Accordingly, as shown in FIGS. 8A and 8B, only the second upper protection layer 107*b* is disposed in the thin film region 113. In this manner, the first upper protection layer 107*a* is partially formed and the second upper protection layer 107*b* is disposed on the entire upper protection layer 107*a* to form the thin film regions 113. Therefore, since the second upper protection layer 107*b* can be formed to have a predetermined thickness by sputtering in the thin film region 113, it is possible to precisely maintain a film thickness of the thin film regions 113.

Third Embodiment

Next, an inkjet head of a third embodiment will be described.

FIGS. 9A to 9G illustrate a process for manufacturing an inkjet head according to the third embodiment. FIG. 9A is a plan view of a thin film region 113 in the inkjet head of the third embodiment. FIG. 9B is a cross-sectional view taken along line IXB-IXB of FIG. 9A. In the inkjet head of the third embodiment, an upper protection layer 107" includes a third upper protection layer 107*c* disposed at a lower position to have a thickness of 50 nm and a fourth upper protection layer 107*d* disposed at an upper position to have a thickness of 250 nm. In the third embodiment, as in the second embodiment, thin film regions 113 are formed such that one of the layers forming the upper protection layer 107" extends toward the common section 110. Moreover, in the inkjet head of the third embodiment, the third upper protection layer 107*c* is made of Ir or Ru, and the fourth upper protection layer 107*d* is made of Ta.

As shown in FIGS. 9A and 9B, in the thin film region 113, the fourth upper protection layer 107*d* is removed, and only the third upper protection layer 107*c* is disposed. FIGS. 9C and 9E are cross-sectional views of a substrate for the inkjet head illustrating the steps of the manufacturing process for explaining the process of manufacturing the inkjet head according to the third embodiment.

In the stage shown in FIG. 9C, the substrate for the inkjet head is the same as that shown in FIG. 6B of the first embodiment. Therefore, the steps to the stage shown in FIG. 9C of the process for manufacturing the substrate for the inkjet head are performed in the same manner as in the first and second embodiments.

Next, the third upper protection layer 107*c* is disposed on the protection layer 106. In this step, the third upper protection layer 107*c* is formed to have a thickness of about 300 nm. In the present embodiment, the third upper protection layer 107*c* is made of a Ta layer. Moreover, the third upper protection layer 107*c* is formed to have a thickness of 50 nm by sputtering.

Then, as shown in FIG. 9D, the third upper protection layer 107*c* is formed to have a predetermined shape. In this step, dry etching is performed by using the photolithography method to form the third upper protection layer 107*c* in a predetermined shape while removing other portions.

Then, the fourth upper protection layer 107*d* made of a Ta layer is disposed on the third upper protection layer 107*c*. In this step, the fourth upper protection layer 107*d* is formed to have a thickness of about 300 nm. The fourth upper protection layer 107*d* is formed to have a predetermined thickness of about 300 nm by sputtering. In this step, the fourth upper protection layer 107*d* is formed on the entire third upper protection layer 107*c* to cover the third upper protection layer 107*c*.

Next, dry etching is performed by using the photolithography method to partially remove the fourth upper protection layer 107*d* at positions where the thin film regions 113 are formed. The etching is performed on the fourth upper protection layer 107*d* until it reaches the third upper protection layer 107*c*. As a result, the upper protection layer 107" is formed in which the fourth upper protection layer 107*d* is removed for the thin film region 113. Accordingly, as shown in FIG. 9E, the upper protection layer 107" is formed in which only the third upper protection layer 107*c* is disposed for the thin film region 113, and the third upper protection layer 107*c* and the fourth upper protection layer 107*d* are disposed and laminated for other portions.

The subsequent step of forming the external electrode 111 (FIG. 9F) and step of forming the flow path forming member 120 (FIG. 9G) are performed in the same manner as in the first and second embodiments.

In the inkjet head manufactured by the above manufacturing process, first, the third upper protection layer 107*c* and the fourth upper protection layer 107*d* are disposed. Then, etching is performed on the fourth upper protection layer 107*d* at positions where the thin film regions 113 are formed until it reaches the third upper protection layer 107*c*, and the fourth upper protection layer 107*d* is removed to form the thin film regions 113. Accordingly, in the thin film regions 113, since the third upper protection layer 107*c* can be formed to have a predetermined thickness by sputtering, it is possible to precisely maintain a film thickness of the thin film regions 113. Moreover, since the fourth upper protection layer 107*d* is removed by etching at positions corresponding to the thin film regions 113, it is possible to improve the positional precision of the thin film regions 113.

In the third embodiment, the fourth upper protection layer 107*d* is formed larger in a width direction than the upper protection layer 107*c*. It is known that adhesiveness between Ir or Ru forming the third upper protection layer 107*c* and SiN forming the protection layer 106 is not high. In the present embodiment, not only the third upper protection layer 107*c* but also the fourth upper protection layer 107*d* made of Ta adheres partially to the protection layer 106. Therefore, the fourth upper protection layer 107*d* and the protection layer 106 can adhere well via the portion therebetween.

As described above, in the present embodiment, since the fourth upper protection layer 107*d* partially contacts the protection layer 106, adhesiveness between the upper protection layer 107" and the protection layer 106 is relatively good. In addition, to improve the adhesiveness, at a position other than the connection section between the forth upper protection layer 107*d* and the protection layer 106, there may be provided a layer such as a Ta layer as an adhesive layer between the third upper protection layer 107*c* and the protection layer 106.

Other Embodiments

Incidentally, in the present specification, the term "print" is used not only in the case of forming significant information such as characters and graphics but also in the case of forming insignificant information. Further, it widely represents the case of forming images, designs, patterns, or the like on a print medium or the case of processing the print medium, irrespective of whether human can visually recognize results.

The term "printing apparatus" includes an apparatus having a printing function such as a printer, a multifunction printer, a copier, or a facsimile, and a manufacturing apparatus for manufacturing products by using an inkjet technique.

The term "print medium" widely represents a medium which can accept ink such as cloth, a plastic film, a metal plate, glass, ceramic, lumber, leather, in addition to paper used for a general printing apparatus.

In addition, the term "ink" (also referred to as "liquid") should be interpreted as widely as the above-defined "print". The term "ink" represents liquid applied onto a print medium to form images, designs, patterns, or the like, liquid used in processing the print medium, or liquid used in processing the ink (for example, solidifying or insolubilizing a colorant in the ink applied onto the print medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-285440 filed on Dec. 27, 2012, which is hereby incorporated by reference herein in its entirety.

What is claimed is:

1. A substrate for an inkjet head comprising:

a base;

a plurality of heating resistors being disposed on the base and producing heat for heating ink in a case where the heating resistors are energized;

a first protection layer covering the heating resistors and having electrical conductivity; and a second protection layer being disposed between the first protection layer and the heating resistors, the second protection layer electrically insulating the first protection layer from the heating resistors, wherein the first protection layer includes individual sections provided at positions corresponding to the plurality of heating resistors and a common section which commonly connects the individual sections, wherein the individual sections and the common section are connected via connect sections which include at least one of Ir and Ru, wherein the connect sections are formed to have a thickness smaller than that of the individual sections, and wherein the connect sections are eluted by an electrochemical reaction that occurs between the connect sections and ink so that an electrical connection between the individual sections and the common section is cut.

2. The substrate for an inkjet head according to claim 1, wherein the first protection layer and the connect sections include the same material.

3. The substrate for an inkjet head according to claim 1, wherein the first protection layer includes at least one of Ir and Ru.

4. The substrate for an inkjet head according to claim 1, wherein the first protection layer is formed by laminating a plurality of layers, and the connect sections are formed by one of the plurality of layers forming the first protection layer.

5. The substrate for an inkjet head according to claim 1, wherein a thickness of the connect sections is 10-100 nm.

6. An inkjet head comprising:

a substrate for an inkjet head comprising: a base; a plurality of heating resistors being disposed on the base and producing heat for heating ink in a case where the heating resistors are energized; a first protection layer covering the heating resistors and having electrical conductivity; and a second protection layer being disposed between the first protection layer and the heating resistors, the second protection layer electrically insulating the first protection layer from the heating resistors;

a flow path forming member attached to a side of the surface of the substrate on which the first protection layer is disposed for the inkjet head and having ejection ports; and a plurality of liquid chambers defined by the flow path forming member and the substrate for the inkjet head and storing ink therein, each of the plurality of liquid chambers including one of the heating resistors;

wherein the first protection layer includes individual sections which correspond to the plurality of heating resistors and are exposed inside the liquid chambers and a common section which commonly connects the individual sections, wherein the individual sections and the common section are connected via connect sections which are formed at positions where the connect sections contact ink in a case where the ink is stored inside the liquid chambers and which include at least one of Ir and Ru, wherein the connect sections are formed to have a thickness smaller than that of the individual sections, and wherein the connect sections are eluted by an electrochemical reaction that occurs between the connect sections and ink so that an electrical connection between the individual sections and the common section is cut.

7. The inkjet head according to claim 6, wherein in a case where ink is stored inside the liquid chambers and the heating resistors are energized and driven, an electric potential of the ink is lower than a driving potential of the heating resistors.

8. The inkjet head according to claim 6, wherein the first protection layer and the connect sections include the same material.

9. The inkjet head according to claim 6, wherein the first protection layer includes at least one of Ir and Ru.

10. The inkjet head according to claim 6, wherein the first protection layer is formed by laminating a plurality of layers, and the connect sections are formed by one of the plurality of layers forming the first protection layer.

11. The inkjet head according to claim 6, wherein a thickness of the connect sections is 10-100 nm.

* * * * *